United States Patent [19]

Manion

[11] Patent Number: 4,867,041

[45] Date of Patent: Sep. 19, 1989

[54] VORTEX AMPLIFIER DRIVEN ACTUATOR SPOOL

[75] Inventor: Francis M. Manion, Rockville, Md.

[73] Assignee: The United States of America as represented by the Secretary of the Army, Washington, D.C.

[21] Appl. No.: 213,036

[22] Filed: Jun. 28, 1988

[51] Int. Cl.[4] ..... F01B 25/02

[52] U.S. Cl. ..... 91/3; 91/6; 91/52; 91/431; 137/810; 137/813

[58] Field of Search ..... 137/810, 813, 834; 91/3, 52, 6, 19, 165, 166, 431

[56] References Cited

U.S. PATENT DOCUMENTS

| | | | |
|---|---|---|---|
| 3,195,303 | 7/1965 | Widell | 137/813 X |
| 3,386,339 | 6/1968 | Selsam | 91/52 |
| 3,396,631 | 8/1968 | Woodward | 91/3 |
| 3,410,291 | 11/1968 | Boothe et al. . | |
| 3,537,466 | 11/1970 | Chapin . | |
| 3,557,660 | 1/1971 | Palmer | 91/52 X |
| 3,610,099 | 10/1971 | Ankeney | 91/3 |
| 3,665,806 | 5/1972 | Heath | 91/52 |
| 3,682,042 | 8/1972 | Bain | 91/3 |
| 3,731,699 | 5/1973 | Hallum . | |
| 4,091,716 | 5/1978 | Ryan . | |
| 4,265,162 | 5/1981 | Neradka et al. | 91/3 |

OTHER PUBLICATIONS

Wormley, "A Review of Vortex Diode and Triode Static and Dynamic Design Techniques," Fluidic State-of-the-Art Symposium, 1974, Sep. 30-Oct. 3, vol. 1, pp. 1-43.

*Primary Examiner*—Edward K. Look

*Attorney, Agent, or Firm*—Saul Elbaum; Guy M. Miller

[57] ABSTRACT

A hollow cylindrical amplifier driven actuator spool has first and second vortex chambers divided by an internal piston. A shaft is attached to the pistion and extends out the cylinder. Fluid logic controls the fluid flow in the vortex chambers so that the resulting chamber pressure causes the piston to accelerate. The use of beam deflection amplifiers for fluid control in connection with a push-pull vortex amplifier arrangement results in a device with low fluid flow leakage.

9 Claims, 3 Drawing Sheets

VORTEX AMPLIFIER DRIVEN ACTUATOR SPOOL

RIGHTS OF THE GOVERNMENT

The invention described herein may be manufactured, used and licensed by or for the United States Government for Governmental purposes without payment to me of any royalty thereon.

BACKGROUND OF THE INVENTION

1. Field of the Invention

The present invention relates to fluidics and more particularly, is directed towards an actuator driven in a push-pull vortex amplifier driven arrangement.

2. Description of the Prior Art

A servo-actuator spool usually requires considerable input power to provide sufficient control surface system response. Fluidic beam deflection amplifiers that are used to provide the command to the actuator suffer from high flow leakage since they are open center valves.

In a beam deflection amplifier or laminar proportional amplifer (LPA) the supply resistance $R_s$ is defined as $P_s/Q_s$, where $P_s$ is the supply pressure and $Q_s$ is the flow rate. For most beam deflection amplifiers the output resistance is about $\frac{1}{2}$ that of the supply resistance. In a servo-actuator spool the output resistance of the amplifier times the actuator's capacitance defines the first order system time constant. Therefore, in designing a system to meet a fast dynamic response, low amplifier output resistance is required. However, this in turn defines amplifier leakage since these devices are open center valves. In the case of an LPA the leakage is the amplifier's supply flow. For many applications, this flow leakage is too high.

OBJECTS AND SUMMARY OF THE INVENTION

It is therefore an object of the invention to provide a fluid controlled servo-actuator spool that exhibits less leakage than previous designs.

It is a further object of the invention to provide a fluid controlled servo-actuator spool which is controlled by a fluid circuit having no moving-mechanical arts.

The foregoing and other objects in accordance with the present invention are attained through the use of vortex valves driving a servo actuator spool in a push-pull fashion. Vortex valves have the characteristic of full main flow shut off if the control flow induced centrifugal pressure gradient is sufficient to equal the main flow's stagnation pressure. In the shutoff condition, the valves only leakage is that due to the control through-flow. This leakage due to the through-flow is reduced by using higher control stagnation pressure to provide the momentum needed to establish the cutoff radial pressure gradient with less control flow.

DETAILED DESCRIPTION OF THE PREFERRED EMBODIMENTS

Figure 1:
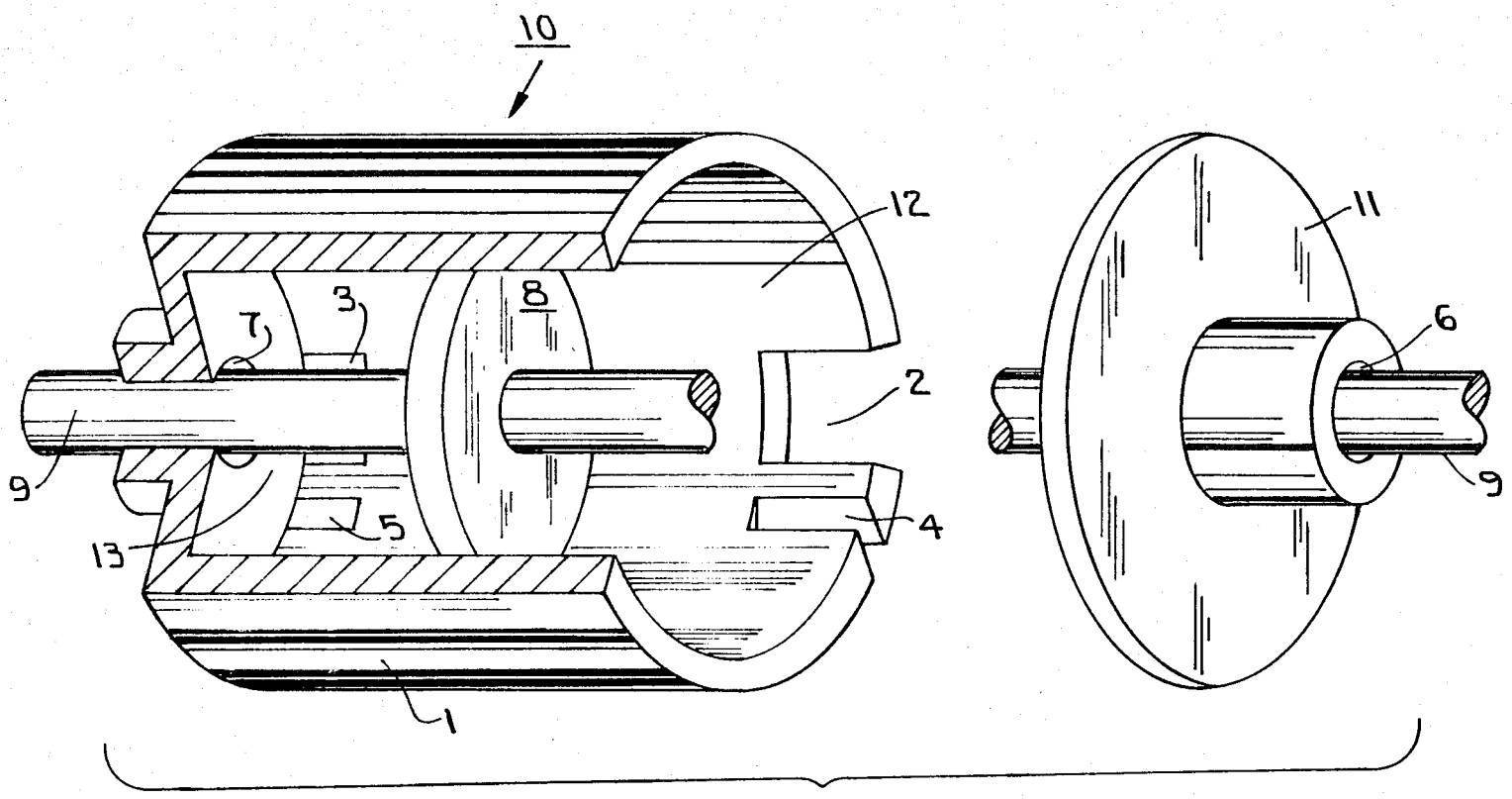
FIG. 1 shows a sectional view of a vortex driven actuator spool according to an aspect of the invention.

Referring now to the drawings, like reference numerals represent identical or corresponding parts throughout the several views.

FIG. 1 shows a vortex driven actuator spool 10 having a hollow cylinder 1. The cylinder 1 has supply ports 2 and 3, vortex including control ports 4 and 5 and exhaust ports 6 and 7. A piston 8 is sealingly inclosed within the cylinder, for axial movement therein, and for dividing the hollow cylinder into a first vortex chamber or valve 12 and a second vortex chamber or valve 13. A spool shaft or rod 9 is attached to the piston 8 and extends out cylinder 1 through exhaust ports 6 and 7. The hollow cylinder 1 shows end 11 separated from the cylinder merely for case of viewing.

Typically, vortex valves provide good flow cutoff, turndown ratio (max. to min. flow), but they require control pressures that are two or three times the supply pressure. In a vortex valve at flow cutoff, the control flow establishes a strong vortex swirl, and in this swirl there is a strong radial pressure gradient that effectively cuts off the supply flow.

Figure 2:
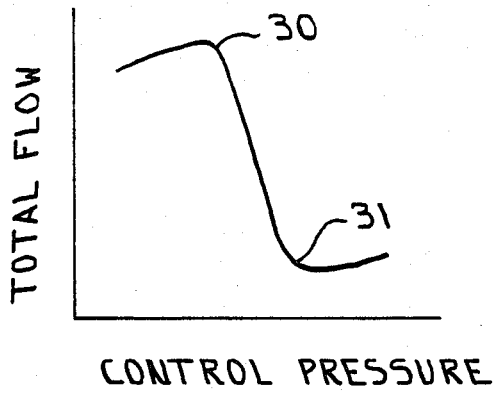
FIG. 2 shows a plot of Total Flow versus Control Pressure for a typical vortex value.

A vortex valve characteristic is shown as sketched in FIG. 2. The maximum through flow occurs at 30 and the minimum flow at supply cutoff occurs at 31.

Figure 3:
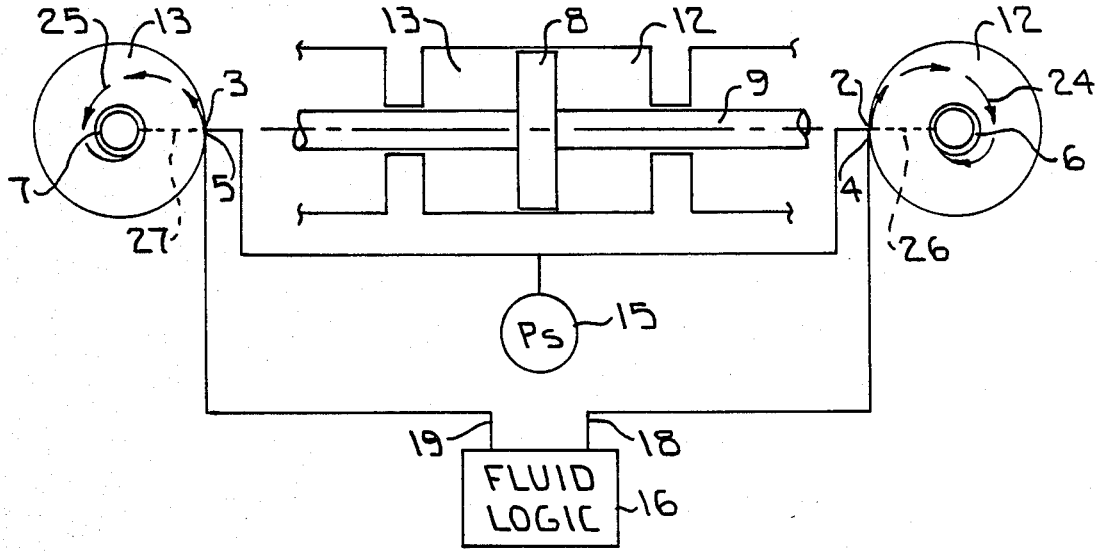
FIG. 3 shows a schematic of a vortex driven actuator spool and control logic in accordance with the present invention.

FIG. 3 shows a schematic of the instant invention. The hollow cylinder 1 is shown with piston 8 sealingly enclosed within the cylinder and for freely moving therein. A spool shaft 9 is attached to piston 8 and extends external to the cylinder 1. The cylinder is divided into a first vortex chamber 12 and a second vortex chamber 13. A source of supply fluid is provided to the vortex chambers through supply ports 2 and 3 by a fluid power source ($P_s$) 15. Fluid logic 16 controls the fluid flow in the vortex chambers 12 and 13 by supplying control fluid through a first control line 18 to the vortex inducing port 4 and a second control line 19 to the vortex inducing port 5.

Figure 4:
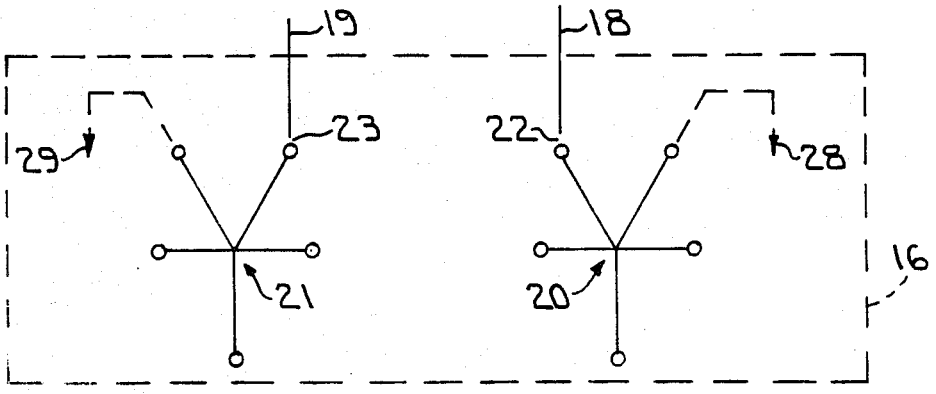
FIG. 4 shows a schematic of fluidic logic as employed in the schematic of FIG. 3.

FIG. 4 shows one possible configuration for the fluid logic circuit 16 which comprises beam deflection laminar proportional amplifiers (LPA) 20 and 21.

In an LPA it is useful to define the supply resistance of the LPA as the ratio of supply pressure ($P_s$) to supply flow ($Q_s$) or supply resistance ($R_s$) as $P_s/Q_s$. For most beam deflection LPA's the output resistance ($R_o$), which is the ratio of control resistance ($R_c$) to supply resistance ($R_s$), is about one half ($\frac{1}{2}$) that of the supply. In designing to meet all dynamic response requirements for an amplifier actuator combination, the output resistance times the actuator's capacitance defines the first order system time constant. As a result, fast response demands low amplifier output resistance and this in turn defines amplifier leakage, which is the amplifier's supply flow, since these devices are open centered valves.

In FIG. 4, the beam deflection amplifiers 20 and 21 provide the vortex valve control fluid to vortex inducing control ports 4 and 5 through control lines 18 and 19 respectively. The vortex valve's control pressure, supplied by the LPA's 20 and 21 at the single sided outputs 22 and 23, is two or three times the vortex supply pressure ($P_s$) supplied to supply ports 2 and 3. The control pressure travels out lines 18 and 19 to vortex inducing ports 4 and 5 respectively. This control pressure is capable of cutting off all the vortex valve's supply flow at supply ports 2 and 3. The purpose of the vortex valve's supply flow is to provide the low output resistance required by the dynamic response of the actuator while permitting use of small LPA's which have low leakage flows.

Referring back to FIG. 3 there are three signal conditions for the actuator spool, no signal (spool at rest condition), full signal left, and full signal right. A no signal condition exists when both vortex valves 12 and 13 are turned off by LPA's 20 and 21 with two times or three times control signals being delivered to vortex inducing ports 4 and 5 respectively. This condition induces tangential flow 24 and 25 in each vortex valve 12 and 13 respectively. A full signal ("right") condition exists when full pressure exists in the left vortex valve 13 and minimum pressure exists in the right vortex valve 12. The control signal delivered to port 5 by line 19 from LPA 21 is turned on while the control signal delivered to port 4 by line 18 from LPA 20 is turned off. The flow pattern of the right vortex valve 12 changes from tangential 24 to radial 26 and the votex chamber pressure drops to near zero; whereas the votex chamber pressure of the left valve 13 is maintained near cutoff. This pressure difference accelerates the piston 8 to the right.

A full signal ("left") condition exists when full pressure exists in the right vortex valve 12 and minimum pressure exists in the left vortex valve 13. The control signal delivered to port 4 by line 18 from LPA 20 is turned on while the control signal delivered to port 5 by line 19 from LPA 21 is turned off. The vortex pressure in left vortex chamber 13 drops to zero; whereas the vortex chamber pressure of the right valve 12 is maintained at near cutoff. This pressure difference accelerates the piston to the left.

The achievement of low leakage and low output resistance by the use of an LPA driving a vortex valve will be described by using the flow pressure figure sketched in FIG. 5.

Figure 5:
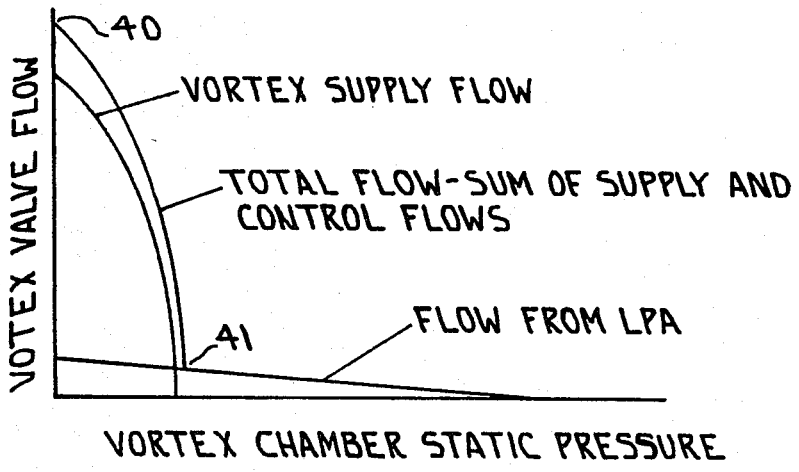
FIG. 5 shows plots of Vortex Valve Flow total flow versus Vortex Chamber Static Pressure for the vortex driven actuator spool.

Points 40 and 41 in FIG. 5 correspond to points 30 and 31 in FIG. 2 for the more typical vortex valve characteristic. Note the abssisa is not control pressure but chamber static pressure.

In the no signal (spool at rest condition), each beam deflection LPA 20 and 21 provides sufficient control to place each vortex valves, 12 and 13, operating point at 41. In this operating condition, only the control flows from LPA outputs 22 and 23, flow through the vortex valves 12 and 13. This is minimum flow leakage.

Referring back to FIG. 3, when a full command signal (right) condition exists, the LPA 21 supplies a control signal through output line 19 to control port 5 of vortex valve 13. LPA 20 has its flow directed from output 22 towards the sump return 28 so that the flow in vortex valve 12 changes from tangential flow 24 to radial flow 26. Consequently, the chamber pressure of valve 12 drops to near zero whereas the vortex chamber pressure of valve 13 is maintained near cutoff. The piston 8 accelerates to the right. The velocity of piston 8 to the right requires flow to support the left chamber pressure. This flow is provided by $P_s$, 15, connected to supply port 3. This flow is supplied along the total flow characteristic shown in FIG. 5. As the chamber pressure of valve 13 drops below the cutoff control pressure, the flow to the chamber is provided along a relatively low output resistance, much lower than the control characteristic from the beam deflection amplifier.

For the sketch of FIG. 5, the data for vortex valve cutoff developed by Wormley, can be used to estimate the reduction in leakage for the same response or the increase in response for the same leakage. This estimate can be most easily made using linear approximation for the resistance characteristic of the LPA and the vortex valve.

Figure 6:
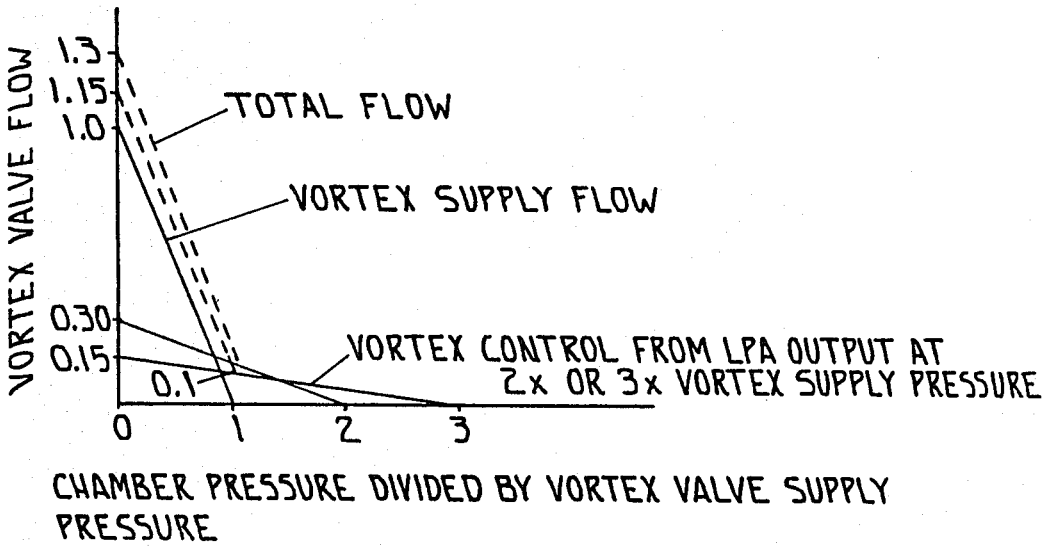
FIG. 6 shows plots of Vortex Valve flow and total flow versus Chamber Pressure divided by Vortex Valve Supply Pressure.

FIG. 6 shows the linear approximation of Vortex Valve Flow versus Chamber pressure divided by vortex valve supply pressure. Using the vortex valve data, 3 times supply pressure for control to reduce the vortex valves through flow to 0.10 of its maximum valve, a resistance comparison can be made. From linearized sketch; the control resistance ($R_c$) is $$\frac{P_s}{Q} = \frac{3-1}{0.1} = 20$$

and the supply resistance ($R_s$) is $$\frac{P_s}{Q} = \frac{1-0}{1.15-0.1} = 0.95$$

Thus for the leakage of an LPA only, the output resistance ($R_o$) is reduced by a factor of 21.00.

$$\frac{Rc}{R_s} = \frac{20}{0.95} = 21.00 = R_o$$

For a control 2 times the vortex supply, the resistances are $$\frac{2-1}{0.15} = 6.67 \text{ for an } LPA$$

$$\text{and } \frac{1-0}{1.30-0.15} = 0.87 \text{ for the vortex valve}$$

Thus the output resistance is reduced by $$\frac{6.67}{0.87} = 7.67$$

For the former case, reduction in output resistance of 21.00, the LPA supply pressure must be 6 times that of the vortex valve due to the 50% pressure recovery of the LPA. If the leakage reduction is 7.67 the LPA supply pressure must be 4 times that of the vortex valve. If a force comparison between the vortex driven by an LPA and the LPA direct driving the piston is made, then the piston area must be increased since the maximum chamberr pressure is not $\frac{1}{3}$ of its original LPA design valve. To develop the same force, the piston area would have to be increased by a factor of $(3)^2$. Piston capacitance is defined as $\Delta$ volume/$\Delta$ pressure. For an area 3 times larger the change in volume for fixed displacement is 3 times but the change in pressure required to obtain this displacement change is only $\frac{1}{3}$, thus the factor of $(3)^2$. Thus for the same response the leakage is only reduced 21.0/9=2.33. For the 2 times design, the leakage is reduced 7.67/4=1.92. Of course, if the leakage was not reduced the response would be increased by these factors. These factors are an indication of the power gain associated with the vortex valve.

Figure 7:
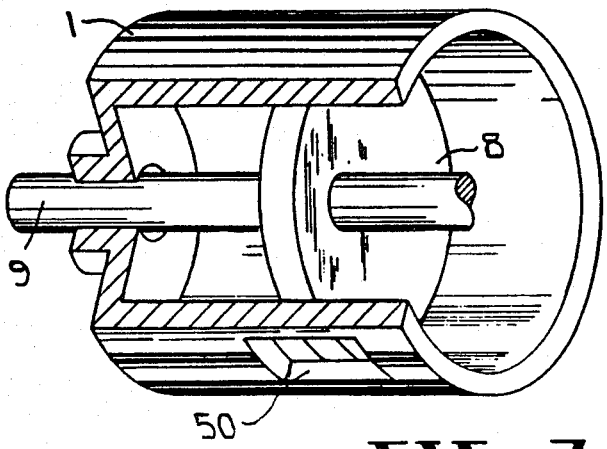
FIG. 7 shows a sectional view of a vortex driven actuator spool according to another aspect of the invention.

FIG. 7 shows another embodiment of the present invention and one that will further reduce the output resistance by allowing the spool piston 8 to modulate the vortex supply port 50. For example, as the piston moves to the right, the left supply area of the supply port 50 increases, lowering the output impedence even more. It will be apparent that the embodiments shown are only exemplary and that various modifications can be made in construction and arrangement within the scope of the invention.

I claim:

1. An amplifier vortex driven actuator spool comprising:

a hollow cylinder;

a piston sealingly enclosed within said cylinder for axial movement therein and for dividing the interior of said cylinder into first and second fluidic vortex chambers;

said cylinder having a first supply port, a first vortex inducing port and a first exhaust port for the first vortex chamber and a second supply port, a second vortex inducing port and a second exhaust port for the second vortex chamber;

means for supplying fluid flow to said first and second supply ports; and means for selectively supplying control fluid to said first vortex inducing port and to said second vortex inducing port.

2. The amplifier vortex driven actuator spool of claim 1 wherein said means for selectively supplying control fluid comprises:

a first beam deflection amplifier with a first output port in fluid communication with said first vortex inducing port; and a second beam deflection amplifier with a second output port in fluid communication with said second vortex inducing port.

3. An amplifier vortex driven actuator spool comprising:

a hollow cylinder;

a piston sealingly enclosed within said cylinder for axial movement therein and for dividing the interior of said cylinder into first and second fluidic vortex chambers;

said cylinder having a first vortex inducing port and a first exhaust port for the first vortex chamber and a second vortex inducing port and a second exhaust port for the second vortex chamber;

said cylinder further having a supply port longitudinally aligned and extending substantially the length of said cylinder;

means for supply fluid flow to said supply port; and means for selectively supplying control fluid to said first vortex inducing port and to said second vortex inducing port.

4. The amplifier vortex driven actuator spool of claim 3 wherein said means for selectively supply control fluid comprises:

a first beam deflection amplifier with an output port in fluid communication with said first vortex inducing port; and a second beam deflection amplifier with an output port in fluid communication with said second vortex inducing port.

5. The amplifier vortex driven actuator spool of claim 3 further comprising:

a shaft attached to said piston and extending external of said cylinder.

6. The amplifier vortex driven actuator spool of claim 5 wherein a first end of said shaft passes through the first output port of said cylinder.

7. The amplifier vortex driven actuator spool of claim 6 wherein a second end of said shaft passes through the second output port of said cylinder.

8. An amplifier vortex driven actuator spool comprising:

a hollow cylinder having first and second ends;

a piston sealingly enclosed within said cylinder for axial movement therein and for dividing the interior of said cylinder into first and second fluidic vortex chambers;

said cylinder having a first supply port, a first vortex inducing port, and a first circular exhaust port formed in the first end of said cylinder and in axial alignment with said cylinder for the first vortex chamber;

said cylinder having a second supply port, a second vortex inducing port port and a second circular exhaust port formed in the second end of said cylinder and in axial alignment with said cylinder for the second vortex chamber;

a cylindrical shaft attached to said pistion and having one end pass through said first circular exhaust port and having the other end pass through said second circular exhaust port;

means for supplying fluid flow to said supply port; and means for selectively supplying control fluid to said first vortex inducing port and to said second vortex inducing port.

9. The amplifier vortex driven actuator spool of claim 8 wherein said means for selectively supplying control fluid comprises:

a first beam deflection amplifier with an output port in fluid communication with said first vortex inducing port; and a second beam deflection amplifier with an output port in fluid communication with said second vortex inducing port.

* * * * *